United States Patent [19]

Sarich

[11] 3,982,755

[45] Sept. 28, 1976

[54] WEIGHT TYPE EXERCISING DEVICE

[75] Inventor: John I. Sarich, Edmonton, Canada

[73] Assignee: The Raymond Lee Organization, Inc., New York, N.Y. ; a part interest

[22] Filed: Apr. 28, 1975

[21] Appl. No.: 571,965

[52] U.S. Cl. ..... 272/117

[51] Int. Cl.[2] ..... A63B 21/06

[58] Field of Search ..... 272/81, 84, 67, 58, 272/DIG. 4, DIG. 5, 117, 118, 122–124, 134; 128/75, 25 R

[56] References Cited

UNITED STATES PATENTS

| | | | |
|---|---|---|---|
| 2,475,656 | 7/1949 | Bidak | 272/81 UX |
| 2,918,282 | 12/1959 | Waterval | 272/81 |
| 3,334,899 | 8/1967 | Bosko et al. | 272/84 |
| 3,398,742 | 8/1968 | Alexander | 128/75 |

*Primary Examiner*—Richard C. Pinkham
*Assistant Examiner*—William R. Browne
*Attorney, Agent, or Firm*—Howard I. Podell

[57] ABSTRACT

A device for use in exercises designed to deepen the chest, broaden the waist and reduce the waistline of the user, which may be utilized by people of different strengths. The device is in the form of a shaped cylindrical rod about which a rope is wound, with a bottle fastened to the free end of the rope. The bottle is transparent and may be filled with water, for users of various physical ability. In use, the rod is grasped by both hands with the arms outstretched and the rod rolled in a direction to wind the rope and raise or lower the attached bottle. The rod has two inverted tapered generally cone shaped sections joined together at their narrowest sections generally in the middle of the rod. The rope is attached to the junction of the narrowest sections.

1 Claim, 2 Drawing Figures

WEIGHT TYPE EXERCISING DEVICE

SUMMARY OF THE INVENTION

My invention is a device for use in exercises designed to deepen the chest, broaden the waist and reduce the waistline of the user, which may be utilized by people of different strengths.

The device is in the form of a shaped cylindrical rod about which a rope is wound, with a bottle fastened to the free end of the rope.

The bottle is transparent and marked with recommended levels to which the bottle should be filled with water, for users of various physical ability.

In use, the rod is grasped by both hands with the arms outstretched and the rod rolled in a direction to wind the rope and raise or lower the attached bottle.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
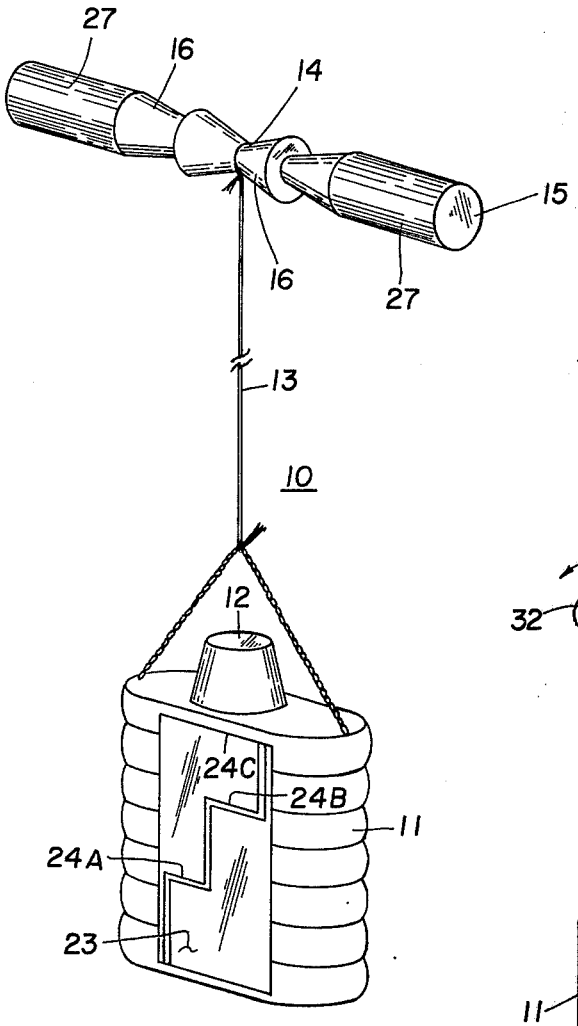
FIG. 1 is a perspective view of the invention.
Figure 2:
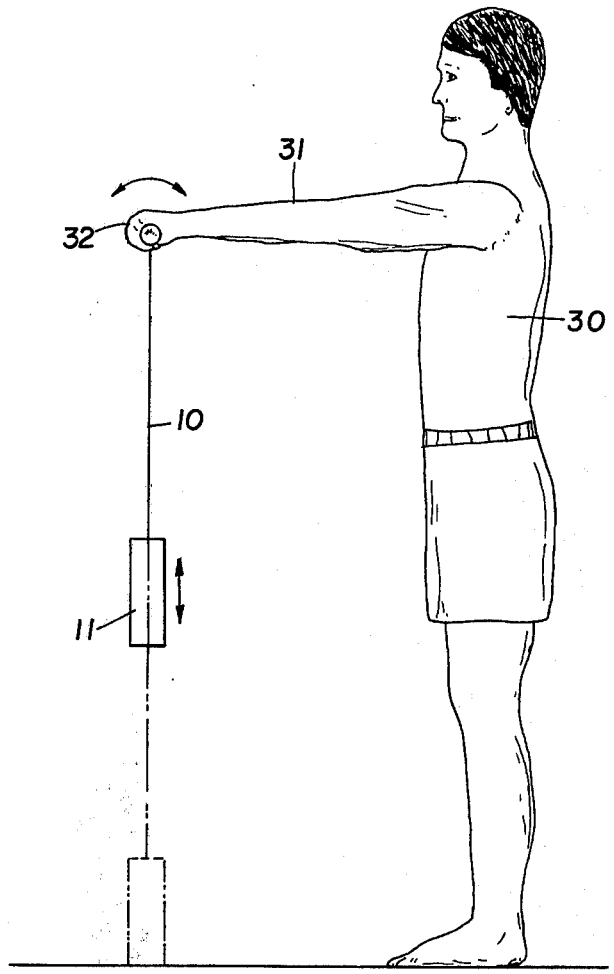
FIG. 2 is a side elevation view of the invention in use.

Turning now descriptively to the drawings, in which similar reference characters denote similar elements throughout the several views, FIGS. 1–2 illustrate the exerciser device 10 which comprises a bottle 11 or other hollow container fitted with a removable cap 12 fastened to a flexible cord 13 that is fastened to the center section 14 of a shaped rod 15. The center section 14 of the rod 15 is recessed so as to retain the cord 13 in the central portion of the rod when it is wound about the rod by a rotary motion of the rod. In the preferred embodiment 10 the central section 14 is recessed in the shape of two inverted tapered sections 16 joined together at their narrowest sections in the middle of the rod 15. Alternately the central section 14 of the rod may be bounded by circular side walls (not shown) to confine the wound cord 13 in the central section 14.

Bottle 11 is preferably transparent or formed with a transparent wall section 23 on which level indications 24A, 24B and 24C are marked. In use, for children, the bottle 11 is filled with water to level indication 24A, and for women, it is recommended that the bottle be filled with water to level indication 24B, with the full bottle of water of a level indicated by marking 24C employed for use by men. In the preferred embodiment, a full bottle of water weighs 850 grams, with markings 24A and 24B indicating the one-third and two-third level position.

The user 30, grasps each cylindrical end 27 of the rod with the hand 32 of an outstretched arm 31, in the standing position and rotates the rod 15 to raise the lower the bottle. Regular such exercise for a period of 5 minutes a day results in the building of arm muscles, deepening of the chest, thickening of the back muscles and broadening of the shoulders as well as a reduction of waistline due to firming of the abdomen muscles.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A device for exercising purposes comprising a cylindrical rod, two inverted tapered generally cone shaped sections joined together at their narrowest sections generally in the middle of the rod, a hollow transparent container having weight indicated indicia, said container being fixed to a flexible cord, the end of which is fastened to the narrowest section of the cylindrical rod, said container being adaptable to filling with an amount of water to achieve a desired weight, said device employed by rotation of the rod, when grasped in the hands of a user, so as to raise or lower the container as the cord is wound or unwound about the rod, the middle portion of the rod being of lesser diameter than the end sections of the rod so as to direct a wound cord to the narrowest section of the rod, and each end of the rod formed of a uniform circular cross-section, to serve as handles.

* * * * *